United States Patent [19]

Emenaker

[11] 4,019,619

[45] Apr. 26, 1977

[54] PAPER FEED SENSING MECHANISM FOR PRINTER

[75] Inventor: Leo J. Emenaker, Playa del Rey, Calif.

[73] Assignee: Printronix, Inc., Irvine, Calif.

[22] Filed: Mar. 22, 1976

[21] Appl. No.: 669,245

[52] U.S. Cl. ..... 197/189; 101/233

[51] Int. Cl.[2] ..... B41J 29/44

[58] Field of Search ..... 197/133 R, 138 A, 187, 197/189, 192, 141; 101/181, 219, 220, 228, 232, 233, 234, 235

[56] References Cited

UNITED STATES PATENTS

| | | | |
|---|---|---|---|
| 2,419,369 | 4/1947 | Ritzert | 197/187 X |
| 2,743,671 | 5/1956 | Weber et al. | 101/235 |
| 3,076,407 | 2/1963 | Zimmerman | 101/233 X |
| 3,356,200 | 12/1967 | De George | 197/133 R X |
| 3,898,930 | 8/1975 | Ikegami et al. | 101/233 X |
| 3,941,051 | 3/1976 | Barrus et al. | 101/93.04 |

OTHER PUBLICATIONS

Trailing Edge Sensor Davis, W. M., IBM Tech. Bull., vol. 7, No. 5, Oct. 1964, p. 390.

Out of Paper Switch for an Unattended Printer, Brown, C. G., IBM Tech. Bull., vol. 17, No. 3, Aug. 1974, p. 642.

*Primary Examiner*—Edgar S. Burr
*Assistant Examiner*—Paul J. Hirsch
*Attorney, Agent, or Firm*—Fraser and Bogucki

[57] ABSTRACT

Both the operative position of a movable platen and the presence of paper to be advanced past the platen in a line at a time printer are affirmatively sensed by a single mechanism. A cantilevered spring arm extending from a fixed mount includes a terminal switch sensor at its free end in proximity to the paper. At an intermediate region along its length the spring arm traverses adjacent to but spaced apart from the platen, and an adjustable set screw on the arm is disposed for contact with the platen. When the platen is in the operative position, behind the print hammers, and the printer is loaded with paper, the spring arm biases the actuator into contact with the paper, transferring the switch contact to a given position and thereby indicating that both needed prerequisites for printer operation are satisfied. If the platen is disengaged from its normal position, as for paper loading, the spring arm is concurrently moved away from the paper and the switch actuator freed to transfer the switch to its opposite contact. In the absence of paper the switch actuator is also freed regardless of platen position. The length of travel of the spring arm is substantially greater than that of the switch actuator and the spring arm has a greater spring force than the switch actuator arm, insuring both forceful operation of the switch despite variations in paper thickness, and easy vernier adjustment of the trip point of the switch.

7 Claims, 4 Drawing Figures

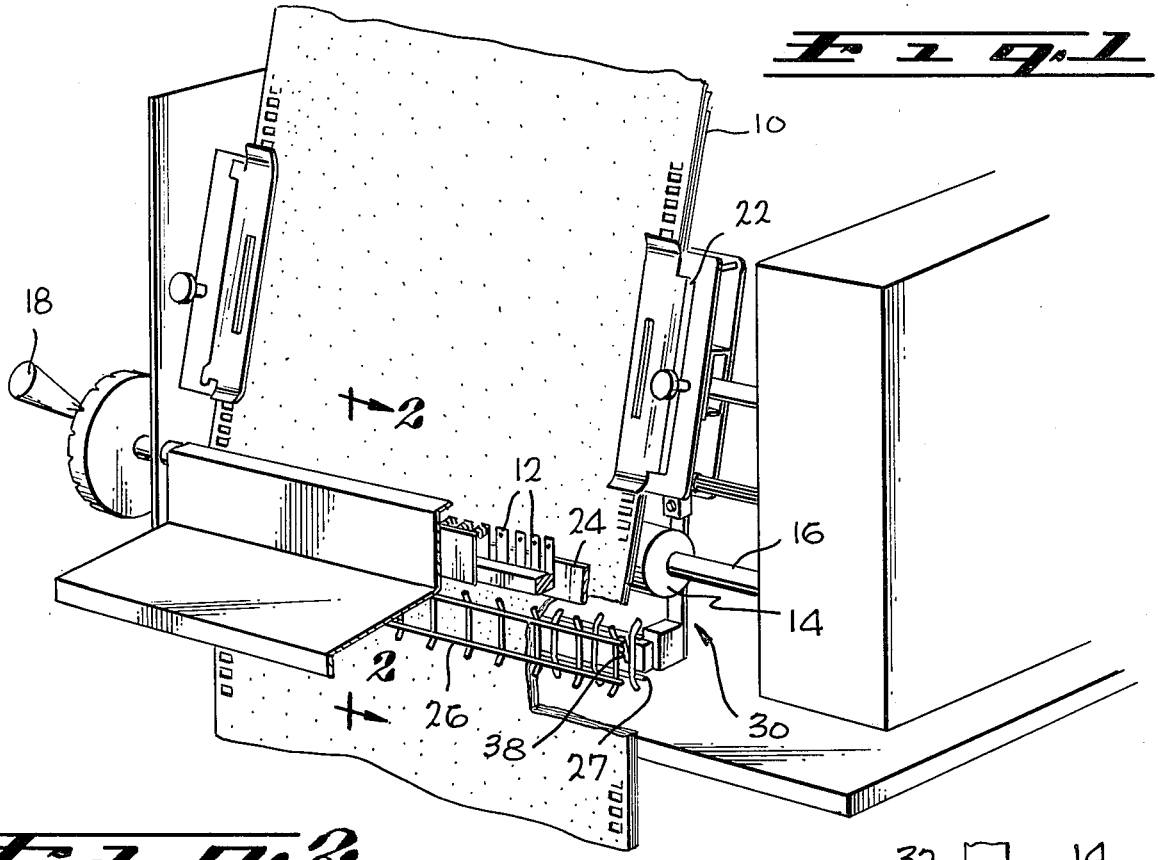
Fig. 1
Fig. 2
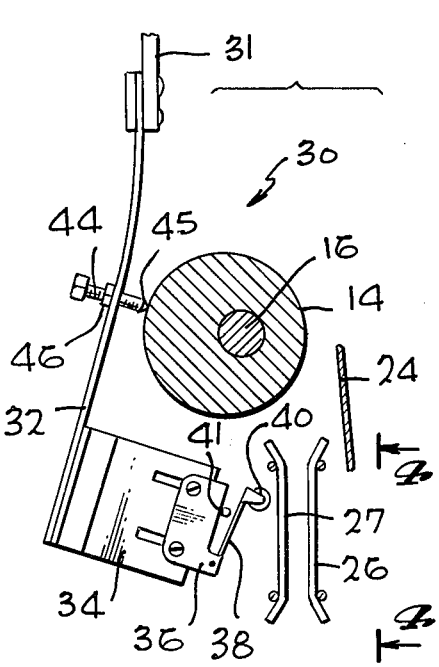
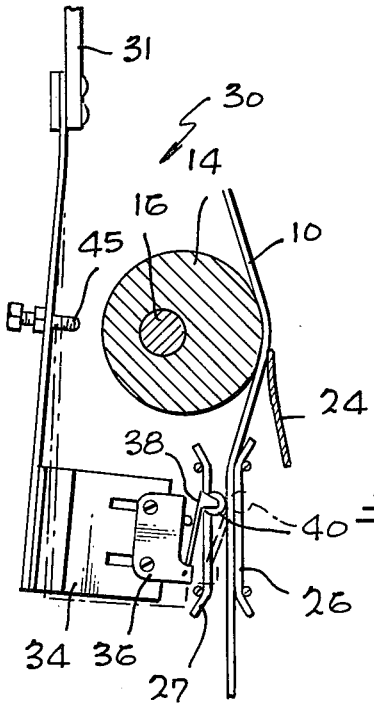
Fig. 3
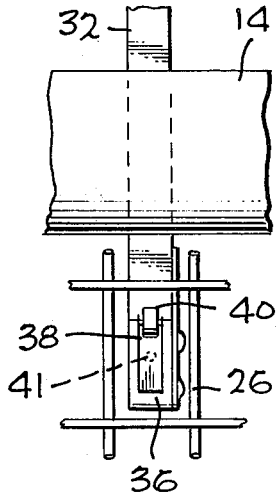
Fig. 4

PAPER FEED SENSING MECHANISM FOR PRINTER

BACKGROUND OF THE INVENTION

A typical data processing printer operates on a line-at-a-time basis, using forceful impacting of printing elements on multiple paper sheets. The printing elements may be front mounted, as with a dot matrix printer, in which case a platen or bed mechanism of some kind is used to provide a base against which the printing elements may react. The platen is advantageously movable away from the paper, for freedom in loading paper and for adjustment for different paper thicknesses. Such a mechanism is shown in recently issued U.S. Pat. No. 3,941,051 entitled "Printer System" and assigned to the assignee of the present invention. A variety of other printer mechanisms in which different structures are separable to permit paper insertion have also been employed. In general it is considered highly desirable to affirmatively sense both the operative position of the platen or equivalent structure, and the presence of paper in the system. Operation without paper would damage the printing elements and platen, while operation with paper in but the platen withdrawn would result in loss of data. The platen must, however, be open (spaced apart from the paper path) for easy paper loading.

The "paper out" condition is generally sensed in such printers by the actuator arm of a small electromechanical switch, such as the widely used "Microswitch" (a trademark of Honeywell, Inc.). In most prior art structures the actuator arm of the switch is easily depressed and presents no barrier to paper loading. However, once the paper is inserted it cannot be adjusted sideways, and if improperly aligned can only be withdrawn and reinserted. The switch must also be unresponsive to normally encountered variations in the paper, such as are introduced by bulges, fold lines, and perforations in fan fold paper. These variations, however, can exceed in distance the short operating travel of the switch actuator. Thus with existing systems the actuator must be precisely positioned and accurately set, but can still provide erroneous paper out indications because of paper variations. The platen open status normally requires a second sensor, which may be another switch or may be a contact arm spaced to engage the withdrawn platen.

SUMMARY OF THE INVENTION

A sensing mechanism in accordance with the invention disposes a cantilevered spring from a fixed base to have a free end adjacent the printing medium, and to be responsive at an intermediate region to the position of a movable platen. Substantial movement of the platen away from the paper automatically disengages a switch at the free end of the spring from the paper, causing the switch to transfer contacts even if paper is present. If paper is out, the same switch also transfers contacts regardless of the position of the platen.

In a specific example of a sensing system in accordance with the invention the ratio between the displacement of the end of the cantilevered leaf spring and the travel of the switch actuator is made significantly large. The spring force of the leaf spring exceeds that of the actuator arm and excessive variations in paper thickness or characteristics are thus compensated for by the spring action of the cantilever mechanism. A large effective throw is thus provided for the switch, making paper sensing uncritical, while a vernier adjustment of the spring arm relative to the platen can be made to insure precise indication of excessive displacement of the platen relative to the paper. The paper bridges a paper guide gridwork which provides a non-frictional reactive force against the actuator arm, but through which the actuator arm can move when no paper is present.

BRIEF DESCRIPTION OF THE DRAWINGS

A better understanding of the invention, as well as the invention itself, may be had by reference to the following description, taken in conjunction with the accompanying drawings, in which:

FIG. 1 is a simplified perspective view of a portion of a printer system employing a paper feed sensing mechanism in accordance with the invention;

FIG. 2 is a side view of the sensing mechanism of FIG. 1, showing a platen in the withdrawn position and with paper not present;

FIG. 3 is a side view of the sensing mechanism, showing the platen in the operative position and showing the mechanism with paper loaded; and FIG. 4 is a front view of a portion of the sensing mechanism as seen in FIG. 3 but with the paper not shown for clarity.

DETAILED DESCRIPTION OF THE INVENTION

Only those parts of a printer system that pertain to a sensing mechanism in accordance with the invention are shown in the simplified fragmentary view of FIG. 1, inasmuch as reference may be made to the above-identified U.S. Pat. No. 3,941,051 for further details. It should be expressly understood, however, that the present invention may be applicable to any such systems in which a movable impact member is disposed adjacent the printing medium and both paper out and platen out (or its equivalent) conditions are to be detected.

In the system, the printing medium comprises one to a plurality of paper webs 10, the number being variable at the user's option. The paper 10 moves upwardly along a predetermined path from a supply (not shown) to a takeup or hopper (not shown) and in doing so passes a printing position or line along which (in this example) are disposed a number of print hammers 12 on the front side of the paper 10. In the above-identified patent the lateral reciprocation of the bank of hammers 12 and the manner in which the hammers are actuated are fully described, so it suffices here to note that characters, symbols or plots are printed in dot matrix patterns and that other printers can provide like functions. Typically, an inked ribbon (omitted for clarity) is fed between the print hammers 12 and the first or original paper 10, and the remainder of the paper copies comprise pressure responsive sheets, such as carbon paper or paper with micro-encapsulated ink. The paper 10 may be of the continuous fan fold type, and in any event can be subject to considerable variation in thickness, such as at wrinkles, fold lines and perforations.

The print hammers 12 impact ultimately against an adjustable platen 14 positioned on the back side of the paper 10 adjacent the paper path. The platen 14 is advantageously a hard-surfaced cylindrical member mounted parallel to the printing line on an eccentric shaft 16 and movable a minor amount toward or away from the paper path by pivoting of a control handle 18. Minor adjustment within a given range of control handle positions permits variation of platen 14 position for paper thickness; a further displacement (effected by a further pivoting of the control handle 18) is also used in which the platen 14 is shifted back away from the paper path to permit paper loading. The further displacement is comparatively major by comparison to paper thickness adjustments and creates a condition in which there is loss of data if printing is attempted.

The paper 10 is advanced past the printing position by conventional paper tractors 22, and held firm thereat by a paper ironer 24 comprising a thin plate on the front side exerting uniform drag to keep the paper 10 in tension and also to iron out air bubbles and imperfections by urging the paper 10 against the platen 14. Below the platen 14 and on both sides of the paper 10, open gridworks of guide rods 26, 27 forming diverging entry and exit portions provide non-frictional planar support and guiding of the paper 10. The above-defined structure, apart from the guide rods 26, 27 is described in the previously mentioned patent.

A sensing mechanism 30 for monitoring both paper out and platen out conditions is mounted on a fixed base 31 on the back side of the paper 10. Typically, the sensing mechanism 30 is disposed adjacent one margin of the printer (usually the left margin) in order to print narrow forms inserted with an edge aligned with the margin. A cantilevered leaf spring 32 coupled to the base 31 extends past and adjacent to the platen 14, at an angle approximately normal to its direction of displacement relative to the paper. A switch bracket 34 is coupled to the leaf spring 32 at or adjacent to its free end, and a small electromechanical switch 36 (such as a Microswitch) is coupled to the bracket in a position such that the extending actuator arm 38 of the switch 36 intercepts the paper path when the platen 14 is in the operative position. Although the switch 36 may be said to be "opened" and "closed", it is advantageous to use a double-throw type of switch to complete a circuit in either position of actuation, so that the switch functions to effect contact transfer when the actuator arm is moved adequately in either direction. A roller contact 40 at the terminus of the actuator arm 38 bears against the paper 10 in one of the openings of the gridwork formed by the paper guide rods 26, 27.

The extent of travel of the actuator arm 38 is inherently limited, being dependent upon the chosen switch type in any event but here approximately 0.025 inch at the contact roller 40, and roughly half that at the interior bearing point 41 which the actuator arm 38 depresses to complete the internal circuit. At an intermediate region along the length of the cantilevered leaf spring, however, a vernier set screw 44 is threaded into the spring 32 along an axis approximately axial with the direction of movement of the platen 14 relative to the paper 10. A follower tip 45 on the end of the set screw 44 engages the platen surface when the platen is in the out position, and a locknut 46 on the set screw provides locking in any axial position. For convenience of adjustment, the front end of the set screw 44 may include means (not shown in the Figs.) such as lands or a fixed head for axial variation of set screw position.

In the operation of the sensing mechanism 30, assume that the platen 14 is in the out position, permitting free insertion of the paper 10. The platen 14 thus urges the set screw 44 and the leaf spring 32 back away from the paper path, thereby also removing the contact roller 40 on the switch actuator arm 38 from the path of the paper. The greater distance of the free end and switch 36 from the pivot point, in comparison to the spacing of the platen 14 from the pivot point, multiples the displacement at the free end in comparison to changes in set screw 44 and platen 14 position. Although variations in paper thickness for which minor platen adjustments may be made are typically of the order of 0.015 inch, the platen 14 is displaced much more (e.g. 0.500 inch) for loading paper. With the paper 10 in the operative position, therefore, as shown in FIG. 3, the vernier set screw 44 may be adjusted so as to permit the switch 36 to transfer contacts reliably in response to platen 14 position. This adjustment is made by threading the screw 44 so that the switch 36 becomes open when the platen 14 is opened beyond the point where proper printing can occur.

With the platen 14 open for paper loading, as seen in FIG. 2, the switch 36 is responsively displaced a correspondingly greater amount from the paper path, minimizing chances of interference by or damage to the actuator arm 38. The paper 10 may also be moved freely sideways once inserted. No adjustments are needed for the paper out condition (position of the actuator arm shown in phantom in FIG. 3), because of the dual action of the cantilevered spring 32 and the actuator arm 38. With both paper loaded and platen closed, both the travel of the switch actuator and the spring deflection act to press the actuator into the paper, increasing the effective actuator throw to about 0.500 inch instead of actuator travel alone of the order of 0.025 inch or less. The cantilevered spring 32 is selected to have a higher spring force than the switch actuator arm 38, so that for all variations in paper thickness the actuator is fully depressed against its stop and the variations are absorbed by the large travel available in the long spring 32. Thus there is affirmative sensing of both the platen out and paper out conditions with a single switch, without interference with paper loading. When no paper 10 is present but the platen 14 is in operative position, as shown in FIG. 3 in phantom, the cantilevered spring 32 straightens, inserting the switch 36 and actuator arm 38 some distance through the guide rods 26, 27 networks, as also seen in FIG. 4. This frees the actuator arm 38 to effect contact transfer within the switch 36, indicating the paper out status.

Although various forms and alternatives have been described, it will be appreciated that the invention encompasses all modifications and variations falling within the scope of the appended claims.

What is claimed is:

1. A sensing mechanism for indicating the presence or absence of paper movable along a predetermined path and an operative position of a platen movable outwardly relative to the paper from the operative position, comprising:

cantilevered spring arm means having a fixed end and a free end disposed adjacent the paper, an intermediate region of the spring arm means being adjacent the platen, the position of the free end of said spring arm means being responsive to the position of the platen when moved from the operative position; and switch means coupled to said spring arm means in the vicinity of the free end thereof, said switch means including actuator arm means extending toward the paper path, the displacement distance of the free end of said spring arm means being substantially greater than the travel of said actuator arm means, and the platen holding the actuator arm means away from the paper path when the platen is not in the operative position and permitting said spring arm means to urge said actuator arm means toward the paper path under spring force when the platen is in the operative position, such that said actuator arm means is automatically displaced from the paper path when the platen is moved out from the operative position but reliably responds to the presence of paper despite aberrations and irregularities in the paper when the platen is in the operative position.

2. The invention as set forth in claim 1 above, wherein said mechanism further includes adjustable means coupled to said spring arm means in the intermediate region thereof and abutting against the platen to vary the position of the free end of said spring arm means relative to the platen when the platen is displaced from the operative position.

3. The invention as set forth in claim 2 above, wherein said adjustable means comprises set screw means mounted on said spring means in radially adjustable relation to said platen.

4. The invention as set forth in claim 2 above, wherein said mechanism further includes paper guide means disposed adjacent said actuator arm means and on the opposite side of the paper therefrom for reacting against the force of said actuator arm means on the paper.

5. The invention as set forth in claim 4 above, wherein the spring arm means has a higher spring force than the actuator arm means of said switch means, and wherein said paper guide means comprise open gridworks of guide rods on both sides of the paper.

6. A sensing mechanism for indicating both paper out and platen out conditions in a printer system in which a movable platen positioned on the back side of the paper path is displaceable a minor amount at an operative position to permit minor adjustment for paper thickness and displaceable a larger distance away from the paper to permit easy loading of paper, comprising:

a cantilevered leaf spring arm having a fixed end support means disposed behind the paper, the spring arm extending adjacent and past the platen to a free end proximate the paper path, the spring arm being disposed at an angle substantially normal to the direction of movement of the platen relative to the paper;

an adjustable set screw mounted in the intermediate region along the length of the platen and extending approximately in the direction of movement of the platen relative to the paper, the set screw including a follower member engaging the platen when the platen is in the open position;

an electromechanical switch coupled in the region of the free end of said spring arm and including a resilient actuator arm having a contact positioned to intercept the paper path when the platen is in the operative position, the extent of travel of the actuator arm being substantially less than the displacement of the free end of the spring arm when the platen is displaced for loading and the spring force of said spring arm being greater than that of the actuator arm; and paper guide means disposed on the front side of the paper path in opposition to the actuator arm contact for reacting against the force thereof on the paper.

7. A device for sensing both when a first member mounted behind a paper web in an impact printer is moved away from engagement with the paper and when there is no paper for printing comprising:

a cantilevered spring member having a fixed end and a free end and mounted substantially tangential to and spaced apart from the first member;

an adjustable stop member mounted on the spring member and positioned to abut against the first member when said first member is moved away from engagement with the paper to maintain the free end of the spring member spaced apart from the paper; and switch means mounted on the free end and spaced from the fixed end of the spring member and including an actuator arm extending therefrom in the direction of the paper for contact with the paper when the first member is moved into engagement with the paper.

* * * * *